US005911491A

United States Patent [19]

Huff

[11] Patent Number: 5,911,491

[45] **Date of Patent: *Jun. 15, 1999**

[54] WELT SHOE COMFORT SYSTEM

[75] Inventor: Marvin O. Huff, Parsippany, N.J.

[73] Assignee: Footstar, Inc., Mahwah, N.J.

[ * ] Notice: This patent is subject to a terminal disclaimer.

[21] Appl. No.: 08/978,758

[22] Filed: Nov. 26, 1997

Related U.S. Application Data

[63] Continuation of application No. 08/598,477, Feb. 28, 1996, Pat. No. 5,768,801.

[51] Int. Cl.[6] ..... A43B 13/18; A43D 9/00

[52] U.S. Cl. ..... 36/17 R; 36/17 PW; 36/28

[58] Field of Search ..... 36/28, 30 R, 30 A, 36/31, 17 R, 17 PW

[56] References Cited

U.S. PATENT DOCUMENTS

| | | | |
|---|---|---|---|
| 56,391 | 7/1866 | Etheridge . | |
| 492,994 | 3/1893 | Sawyer . | |
| 973,077 | 10/1910 | Schwartz . | |
| 1,506,975 | 9/1924 | Cooney . | |
| 1,524,489 | 1/1925 | Richards . | |
| 1,538,514 | 5/1925 | Crooker . | |
| 1,721,599 | 7/1929 | Kroeger . | |
| 1,721,982 | 7/1929 | Willis . | |
| 1,751,036 | 3/1930 | Hooke et al. . | |
| 1,803,236 | 4/1931 | Coulson . | |
| 1,807,401 | 5/1931 | Gilkerson | 36/30 R |
| 1,833,606 | 11/1931 | Gillis . | |
| 1,920,112 | 7/1933 | Shaft . | |
| 1,942,001 | 1/1934 | Rohn et al. . | |
| 1,976,389 | 10/1934 | Everston . | |
| 2,021,192 | 11/1935 | Miller . | |
| 2,045,844 | 6/1936 | Everston . | |
| 2,049,227 | 7/1936 | Rohn et al. . | |
| 2,055,072 | 9/1936 | Everston . | |
| 2,086,908 | 7/1937 | Gorman . | |
| 2,126,601 | 8/1938 | Bain . | |
| 2,132,882 | 10/1938 | Rigandi . | |
| 2,139,260 | 12/1938 | Cuozzo . | |

(List continued on next page.)

*Primary Examiner*—M. D. Patterson

[57] ABSTRACT

A shoe or boot manufactured with the Goodyear welt system and a method for manufacturing same which increases the comfort and flexibility of such shoe or boot to levels which were previously unattainable in a shoe or boot manufactured according to the Goodyear welt system. The shoe or boot comprises a rigid innersole board which is pre-cut to incorporate two detachable pieces at the two key impact areas, the heel and forepart, of the shoe or boot, and maintains its structural rigidity while the Goodyear welt stitch is being applied. Once the two detachable pieces of the innersole board are detached, two cushioning pads are attached to provide maximum cushioning and comfort for the user at the key impact areas. Like other Goodyear welt-type products, the shoe or boot is virtually impervious to water, dirt, and other elements that the user desires to keep out of his shoe or boot; however, unlike previous items of footwear made with the Goodyear welt system, the shoe or boot is comfortable for its user to wear, provides superior cushioning and comfort at the key impact areas of the shoe, and attains a level of flexibility which was previously unattainable in shoes and boots made according to the Goodyear welt system.

5 Claims, 2 Drawing Sheets

U.S. PATENT DOCUMENTS

| | | |
|---|---|---|
| 2,171,719 | 9/1939 | Whelton . |
| 2,268,561 | 1/1942 | Baker . |
| 2,318,014 | 5/1943 | Rovick . |
| 2,320,321 | 5/1943 | Brown . |
| 2,405,443 | 8/1946 | Mees . |
| 2,411,850 | 12/1946 | Caratozzolo . |
| 2,467,386 | 4/1949 | Kamborian . |
| 2,477,866 | 8/1949 | Faber et al. . |
| 2,502,774 | 4/1950 | Alianiello . |
| 2,826,770 | 3/1958 | Freeman . |
| 3,125,816 | 3/1964 | Gartner . |
| 3,462,783 | 8/1969 | Glickkman . |
| 4,012,853 | 3/1977 | Turner, Jr. . |
| 4,378,642 | 4/1983 | Light et al. . |
| 4,472,890 | 9/1984 | Gilbert . |
| 4,486,964 | 12/1984 | Rudy . |
| 4,616,431 | 10/1986 | Dassler . |
| 4,783,910 | 11/1988 | Boys, II et al. . |
| 4,794,707 | 1/1989 | Franklin et al. . |
| 5,077,915 | 1/1992 | Gross . |
| 5,092,060 | 3/1992 | Frachey et al. . |
| 5,175,946 | 1/1993 | Tsai . |
| 5,224,277 | 7/1993 | Do . |
| 5,311,674 | 5/1994 | Santiyanont et al. . |
| 5,311,677 | 5/1994 | Mann et al. . |
| 5,331,750 | 7/1994 | Sasaki et al. . |
| 5,367,791 | 11/1994 | Gross et al. . |
| 5,400,527 | 3/1995 | Marega et al. . |
| 5,435,078 | 7/1995 | Pyle . |
| 5,542,196 | 8/1996 | Kantro ..... 36/30 R |

4
4
19
18
16
15
11b'
20b
21
11a'
10
22
23
20a
22
26
24

WELT SHOE COMFORT SYSTEM

This is a continuation of application Ser. No. 08/598,477, filed Feb. 28, 1996, U.S. Pat. No. 5,768,801.

BACKGROUND OF THE INVENTION

This invention relates generally to a welt-type shoe or boot, and a method for manufacturing same, and specifically to such a shoe or boot and method for manufacturing same which attains levels of comfort and flexibility which were previously unattainable in footwear manufactured according to the Goodyear welt system.

The Goodyear welt system of manufacturing shoes and boots is well-known in the industry and the prior art. A shoe or boot made according to the Goodyear welt system is practically indestructible and virtually impervious to water, dirt, and other elements which the user, for obvious reasons, desires to keep out of his shoe or boot.

The process of applying the Goodyear welt stitch to a shoe or boot applies tremendous pressure to the innersole. Therefore, a rigid innersole board is required in shoes and boots made according to the Goodyear welt system. To improve the comfort of such shoes and boots, makers of shoes and boots with the Goodyear welt system position a full-length cushioning pad on top of the innersole board beneath the sock lining. Because of spacial limitations inside the shoe or boot, however, the thickness of padding that may be used is limited, and therefore provides only minimum comfort for the user's feet. Moreover, since such padding is customarily of a uniform thickness, it does not provide additional cushioning at the key impact areas near the heel and forepart of the shoe or boot.

To further improve the comfort of such shoes and boots, users of shoes and boots made with the Goodyear welt system often position an additional full-length cushioning pad on top of the sock lining. In addition to the problems encountered with this arrangement due to the same spacial limitations described above, another problem encountered with this arrangement is that the padding tends to shift during use, which can make the shoe or boot uncomfortable. Also, positioning an additional full-length cushioning pad on top of the sock lining does nothing to increase the flexibility of the rigid innersole board.

SUMMARY OF THE INVENTION

It is, therefore, an important object of the invention to provide a shoe or boot manufactured according to the Goodyear welt system which is comfortable for its user to wear, and which will not permanently deform during application of the Goodyear welt, and which provides additional cushioning at the key impact areas, while retaining all of the benefits of a shoe or boot manufactured by the Goodyear welt system.

It is another object of the invention to provide a shoe or boot manufactured according to the Goodyear welt system which attains a level of flexibility which was previously unattainable in shoes and boots made according to the Goodyear welt system.

In summary, there is provided an invention comprising a shoe or boot manufactured with the Goodyear welt system, and a method for manufacturing same. The shoe or boot comprises a rigid innersole board, which incorporates two detachable pieces at the key impact areas, one at the heel and the other at the forepart of the innersole board, a rib attached to the underside of the innersole board and extending perpendicular to and continuing around the periphery of the underside of the innersole board, two cushioning pads of differing thicknesses, a tempered steel shank, a compressible rib filler, a full-length cushioning pad which lies on top of the innersole board, and a sock lining, such that when the Goodyear welt system is applied to the shoe or boot, the innersole board does not deform and maintains its structural rigidity, and the resulting shoe or boot is flexible and comfortable for the user to wear.

Further objects, features, and advantages of the invention will become evident from a consideration of the following detailed description when taken in conjunction with the accompanying drawings and the appended claims.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figures 1, 2:
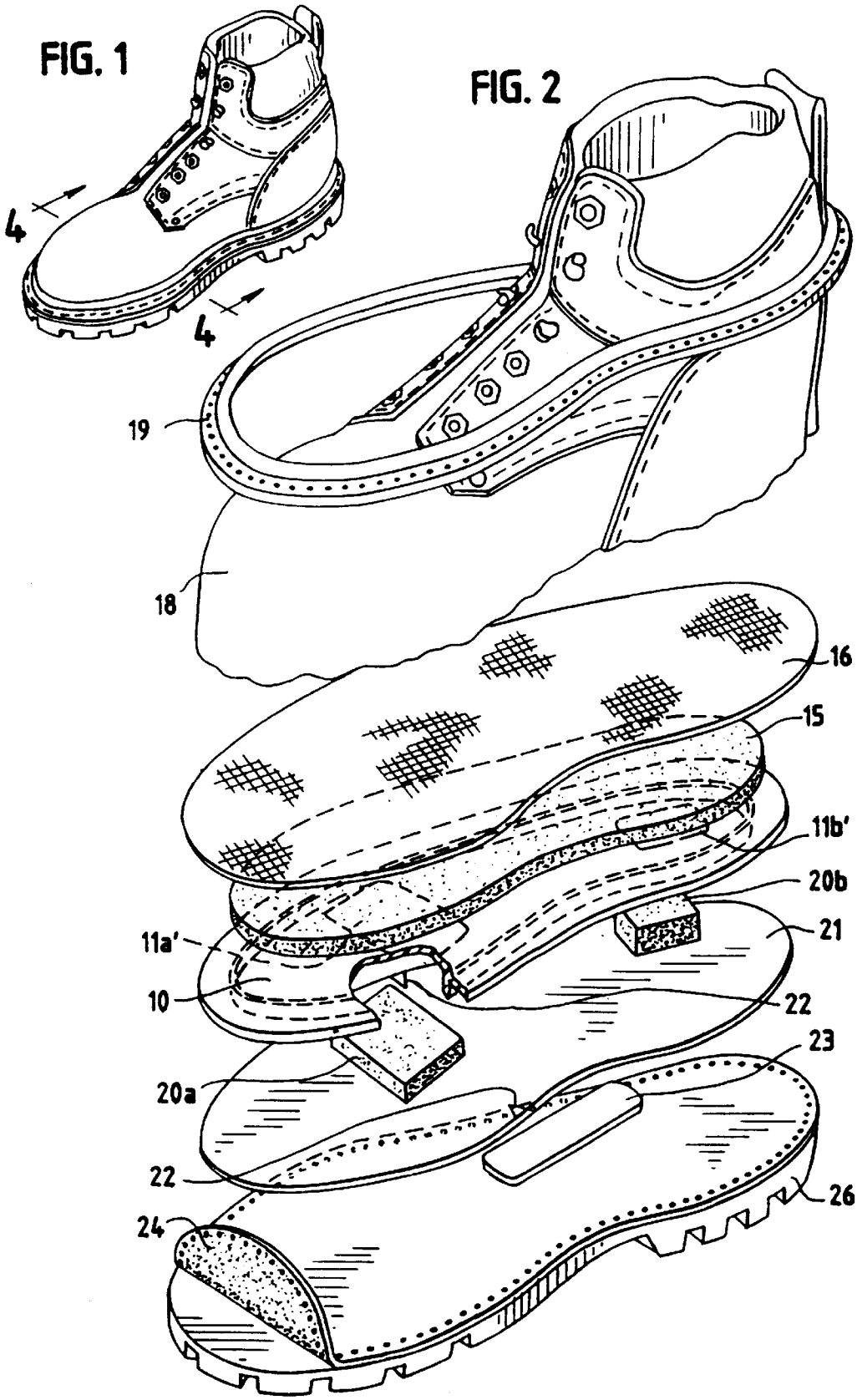
FIG. 1 is a perspective view of a shoe incorporating the present invention.
FIG. 2 is an exploded view of a shoe incorporating a preferred embodiment of the present invention.
Figure 3:
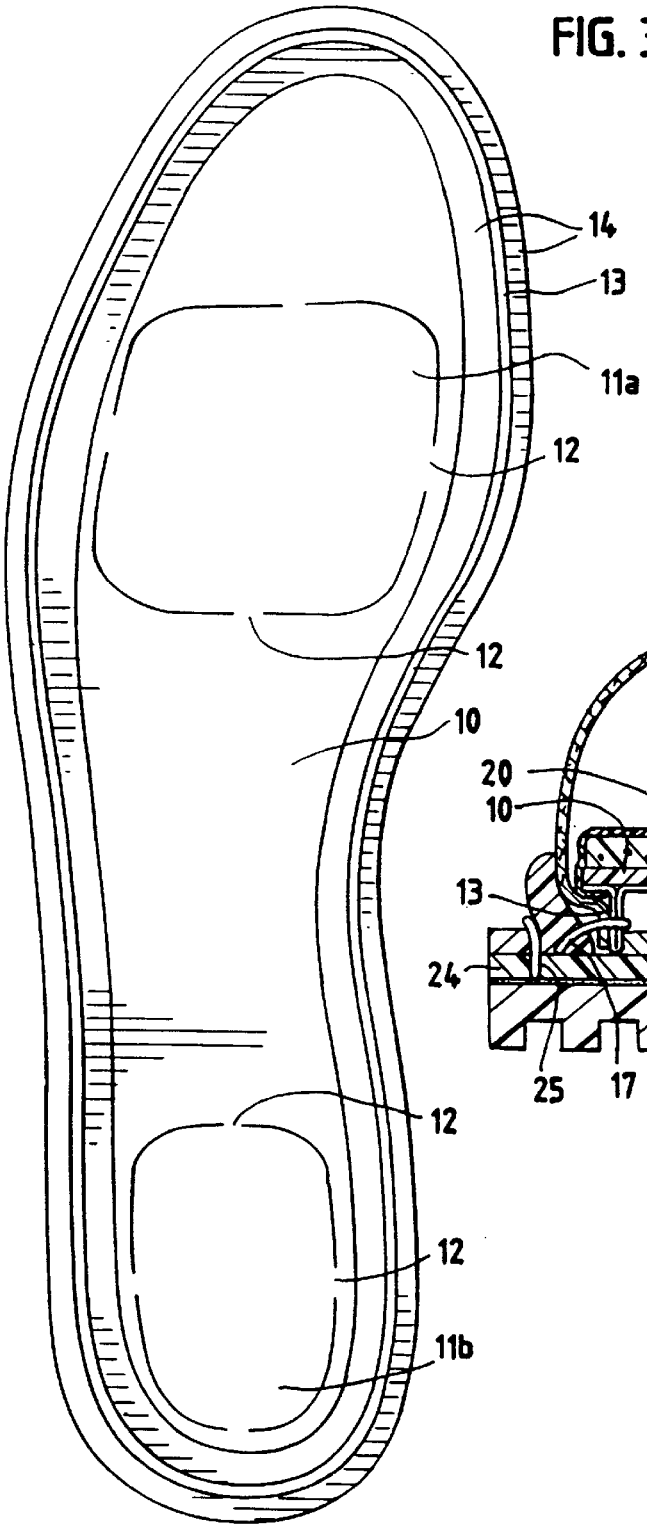
FIG. 3 is a top plan view of a preferred embodiment of the present invention.
Figure 4:
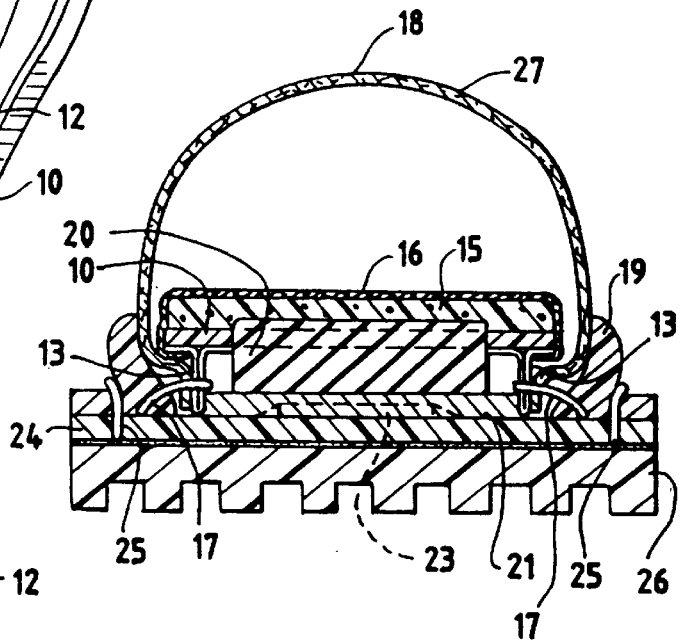
FIG. 4 is a sectional view, taken along the line 4—4 of FIG. 1, of a preferred embodiment of the present invention.

Turning now to FIGS. 2, 3 and 4, there is depicted a preferred embodiment of the invention.

The innersole board (10) can be manufactured of any suitably rigid material that is commonly used to make shoes or boots with the Goodyear welt system. (Meldisco Q. C. Staff, *Shoemaking* [1990], pp. 23–25; and Footwear Industries of America, Inc., *The Art & Science of Footwear Manufacturing*, [Philadelphia: 1983], pp. 24–25). Turning now to FIG. 3, the innersole board (10) is cut with a die which creates two detachable pieces **(11*a*, 11*b*) at the key impact areas, one at the heel (11*b*) and one at the forepart (11*a*) of the innersole board (10), which remain detachably connected to the innersole board (10) during the manufacturing process until shortly after application of the Goodyear welt stitch (17). Each detachable piece remains connected to the innersole board by four uncut attachment areas (12). In a preferred embodiment, each attachment area is 3 mm in length and located in the center of each side of the detachable pieces (11*a*, 11*b*). The attachment areas (12)** provide sufficient strength and structural rigidity for the innersole board during application of the Goodyear welt.

As shown in FIG. 3, in the preferred embodiment, a rib (13) is cemented to the underside of the innersole board (10) with rib tape (14) by a rib cementing machine. In other embodiments, the rib (13) may be cemented directly to the underside of the innersole board (10), or formed directly from, and, thus, integrally a part of, the innersole board (10) itself by slitting the periphery of the underside of the innersole board (10). In all embodiments, the rib (13) is perpendicular to and extends around the entire periphery of the underside of the innersole board (10).

Turning now to FIG. 2, a full-length cushioning pad (15) is placed on top of the innersole board (10). In a preferred embodiment, the full-length cushioning pad is made of high density ethylene vinyl acetate ("EVA"). As best illustrated in FIGS. 2 and 4, in the preferred embodiment, the sock lining (16) is placed on top of the EVA pad (15), wrapped around the innersole board (10), and cemented to the outside edge of the rib tape (14). In other embodiments, the sock lining (16) may be cemented to the inside edge of the rib tape (14) or directly to the underside of the innersole board (10).

As shown in FIG. 4, the welt stitch (17) is applied through the rib (13), upper lining material (27), upper (18), and PVC welt material (19), as is normal procedure in any shoe or boot manufactured with the Goodyear welt system. (Ibid.)

The pre-cut detachable pieces (11*a*, 11*b*) on the innersole board (10) are now removed by eliminating the eight uncut attachment areas (12). As best shown in FIG. 2, the fresh openings (11*a*', 11*b*') expose the high density EVA pad (15) that lies on top of the innersole board (10). In the preferred embodiment, the two cushioning pads (20*a*, 20*b*) are made of polyurethane and cemented to the high density EVA pad (15) through the new openings (11*a*', 11*b*'). In other embodiments, the cushioning pads (20*a*, 20*b*) might be made from a different resilient material suitable for cushioning and might be attached directly to the edges of the fresh openings (11*a*', 11*b*') in the innersole board (10), or, secured differently as described more fully below. The cushioning pads (20*a*, 20*b*) are of differing thicknesses to account for the greater impact at the heel of the shoe. In a work boot, for example, the full length EVA pad (15) might be 4 mm thick, the polyurethane cushioning pad attached at the heel (20*b*) of the innersole board might be 9.5 mm thick, and the polyurethane cushioning pad attached at the forepart (20*a*) of the innersole board might be 6.4 mm thick. In an alternate embodiment, the full length pad (15) might have thicker sections corresponding to the locations of the openings (11*a*', 11*b*'), thus providing additional cushioning without the need for additional pads (20*a*, 20*b*).

As can be seen in FIGS. 2 and 4, a filler (21) of uniform thickness is die cut to fit inside the rib (13) and cemented to the innersole board (10). In another embodiment, the rib filler (21) might have thicker sections corresponding to the locations of the fresh openings (11*a*', 11*b*'), thus providing additional cushioning without the need for additional pads (20*a*, 20*b*). In yet another embodiment, the cushioning pads (20*a*, 20*b*) might be attached to the top surface of the rib filler (21) in locations which correspond and align with the fresh openings (11*a*', 11*b*') in the innersole board (10). In yet another embodiment, the cushioning pads (20*a*, 20*b*) might be positioned, but not attached, within the new openings (11*a*', 11*b*'), and held in position once the rib filler (21) is cemented to the underside of the innersole board (10).

A shank (23) is applied in its normal position, as shown in FIGS. 2 and 4, such that it lies between the two cushioning pads (20*a*, 20*b*). In a preferred embodiment, the rib filler (21) is made of EVA and the shank (23) is made of tempered steel. In a work boot, the EVA rib filler (21) might be 4 mm thick. As shown in FIG. 2, two notches (22) are cut into the EVA rib filler (21) to indicate the rear end of the forepart detachable piece (11*a*), thus ensuring that the shank (23) is not positioned in the cushioned areas (12).

Turning now to FIG. 4, the midsole (24) is applied and stitched to the welt material (19), locking in place the cushioning pads (20*a*, 20*b*), shank (23), and EVA rib filler (21), and compressing the cushioning pads (20*a*, 20*b*), as is normal procedure with shoes and boots manufactured according to the Goodyear welt system. (Ibid.)

As shown in FIG. 4, the outsole (26) is then cemented to the midsole (24) as is normal Goodyear welt procedure. (Ibid.) Once the last is removed, the cushioning pads (20*a*, 20*b*), which were compressed during the manufacturing process as described above, will return to their original thickness by extending upward through the openings (11*a*', 11*b*') in the innersole board (10).

The resulting shoe or boot provides its user with a previously unattainable level of comfort in a shoe or boot manufactured with the Goodyear welt system in that the two cushioning pads (20*a*, 20*b*) provide additional cushioning at the two key impact areas, the heel and toe. The resulting shoe or boot also provides its user with a previously unattainable level of flexibility in footwear manufactured according to the Goodyear welt system in that the two detachable pieces (11*a*, 11*b*), which provide the innersole board (10) with the necessary structural rigidity during application of the Goodyear welt stitch (17), when detached, allow the innersole board (10) to flex more freely when the user walks.

The invention has been described above in an illustrative manner and it is to be understood that terminology which has been used is intended to be in the nature of description rather than of limitation. Obviously, many modifications and variations of the present invention are possible in light of the above teachings. It is, therefore, to be understood that within the scope of the claims, the invention may be practiced otherwise than as specifically described.

What is claimed is:

1. A shoe construction comprising:

an outersole, a rigid innersole board having two spaced-apart openings formed therethrough, a cushioning structure including a first portion overlying said innersole board and two second portions respectively extending through said openings, and a flexible and resilient filler structure disposed between said innersole board and said outersole and covering said second portions of said cushioning structure.

2. The shoe construction of claim 1, wherein said filler structure is attached to said second portions of said cushioning structure.

3. The shoe construction of claim 1, wherein said openings are respectively formed in heel and forefoot regions of said innersole board.

4. The shoe construction of claim 1, wherein said first portion extends substantially the length of said innersole board.

5. The shoe construction of claim 1, wherein said filler structure extends substantially the length of said innersole board.

* * * * *